US006322174B1

(12) United States Patent
Palmqvist

(10) Patent No.: US 6,322,174 B1
(45) **Date of Patent: *Nov. 27, 2001**

(54) ARRANGEMENT FOR EXHIBITING AN OBJECT

(76) Inventor: Åsa Palmqvist, Djurgardsvägen 6, 612 31 Finspang (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/387,908

(22) Filed: Sep. 1, 1999

(51) Int. Cl.[7] ..... A47F 3/00
(52) U.S. Cl. ..... 312/114; 312/140
(58) Field of Search ..... 312/114, 140, 312/204; 40/714, 716, 766, 782, 783, 785

(56) References Cited

U.S. PATENT DOCUMENTS

| | | | | |
|---|---|---|---|---|
| 3,532,209 | * | 10/1970 | Bonis et al. | 312/118 X |
| 3,811,214 | * | 5/1974 | Tate | 40/782 |
| 3,955,298 | * | 5/1976 | Kapstad | 40/716 X |
| 4,031,643 | * | 6/1977 | Templeton | 40/766 |
| 4,244,303 | * | 1/1981 | Kurasik | 40/766 X |
| 4,261,122 | * | 4/1981 | LeVine | 40/766 X |
| 4,630,386 | | 12/1986 | Wilson . | |
| 4,729,183 | * | 3/1988 | Tarter et al. | 403/403 X |
| 4,964,231 | * | 10/1990 | DeMaat et al. | 40/785 X |
| 5,247,744 | * | 9/1993 | Ferris et al. | 40/780 X |
| 5,479,733 | * | 1/1996 | Kusina | 40/785 |
| 5,555,654 | * | 9/1996 | Hermann | 40/714 |

FOREIGN PATENT DOCUMENTS 2 629 702 10/1988 (FR) .

* cited by examiner

*Primary Examiner*—Peter M. Cuomo
*Assistant Examiner*—Hanh V. Tran

(57) ABSTRACT

An arrangement for exhibiting an object, for example a flower arrangement. It includes a bottom panel (2) and a panel made of a transparent material (3) between which the object is adapted to be placed and members are adapted to secure the bottom panel relative to the transparent panel. The arrangements has a frame molding (1) which is adapted to surround the bottom panel (2) and the transparent panel (3). The frame molding has a first cavity (5) extending around and inside the frame molding (1) in which the bottom panel (2) is adapted to be secured. On an inside thereof the frame molding has a second cavity (6) that is disposed a distance from the first cavity (5) in which the transparent panel (3) is disposed after being inserted and rested therein. The arrangement has further a member adapted to permit pushing in and pulling out of the transparent panel into and out from the frame.

4 Claims, 4 Drawing Sheets

FIG. 7
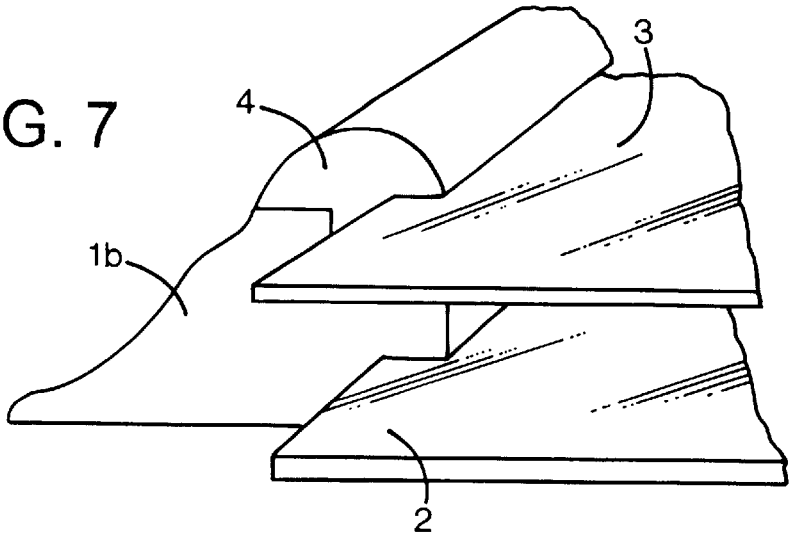
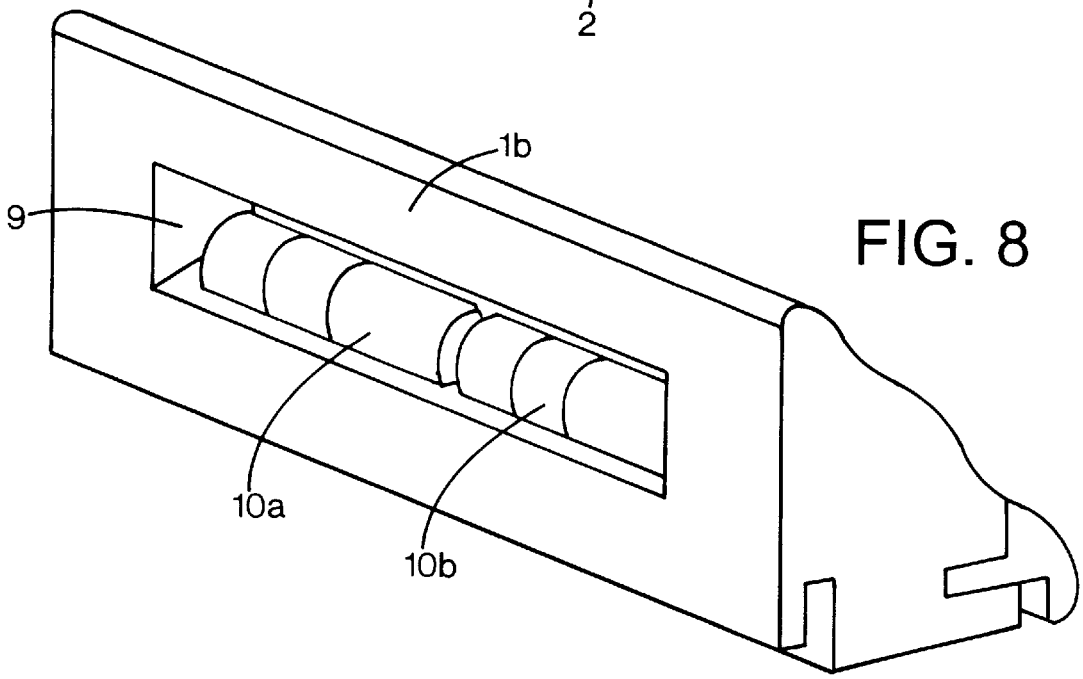
FIG. 8
FIG. 9
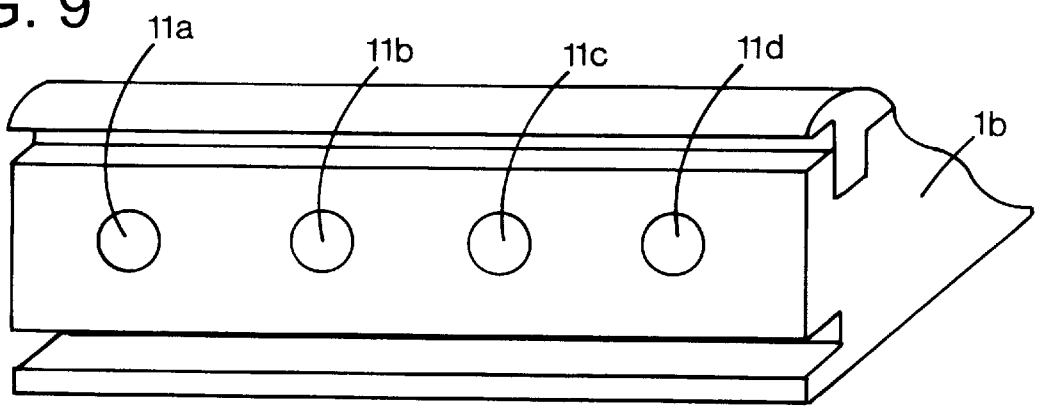

ARRANGEMENT FOR EXHIBITING AN OBJECT

TECHNICAL FIELD

The present invention relates to an arrangement for exhibiting an object, for example a flower arrangement, including a bottom panel and a panel made of a transparent material between which the object is adapted to be displaced and a member that is arranged to secure the bottom panel relative to the transparent panel.

BACKGROUND AND SUMMARY OF THE INVENTION

Today there are different types of frames available that has a bottom panel and a glass panel for enclosing an object, that are three dimensional. It is characteristic for these to be complicated to use and they require a relatively large effort and dexterity by the person that encloses the object. In a previously known embodiment, a frame molding is first turned upside down wherein the glass panel is placed therein. Thereafter, a distance molding is nailed securely thereto with a nail et cetera. The distance molding thus creates a space between the glass panel and the bottom panel.

The present invention relates to providing an improved frame that is easy to use for enclosing objects that extend three dimensionally.

This is achieved with an arrangement for exhibiting an object, as outlined in patent claim 1. The preferred embodiments of the present invention also include features outlined in one or some of the dependent claims.

The present invention has several advantages compared to earlier known arrangements for exhibiting three dimensional objects. One advantage is that it is very easy for the user of the arrangement of the present invention to remove the glass panel from the front to, for example, exchange the object and put back the glass panel. Another advantage is that there is a distance between the bottom panel and the glass panel therein so the frame has a depth. Yet another advantage is that the material usage can be reduced compared to earlier known arrangements. Additionally, the built in illumination has several advantages. For example, the problem of reflections in the glass is avoided.

BRIEF DESCRIPTION OF THE DRAWINGS

The resent invention is hereinafter described as an example with reference to the attached drawings wherein:

FIG. 7 shows the frame molding in FIG. 6 including the bottom panel and the glass panel.

FIG. 8 shows an example of a frame molding according to another embodiment including a retracted illumination.

FIG. 9 shows another view of the frame molding in FIG. 8.

DETAILED DESCRIPTION

Figure 1:
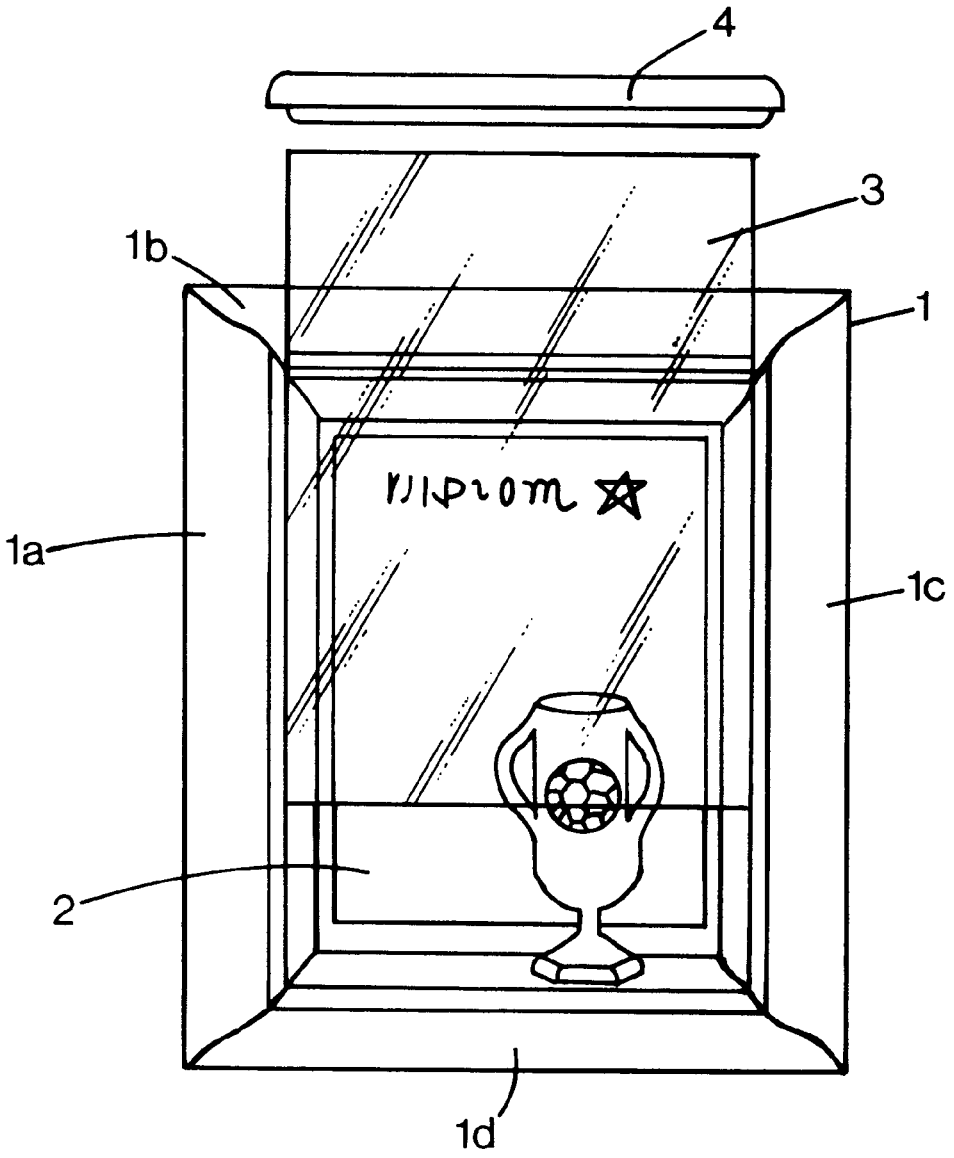
FIG. 1 shows an example of an arrangement according to a first embodiment of the present invention.

The arrangement in FIG. 1 has a frame 1 including frame moldings 1*a*, 1*b*, 1*c*, 1*d* and a bottom panel 2 and a panel that is made of a transparent material, such as a glass panel 3. In another embodiment, the panel 3 is plexiglass. The moldings 1*a*, 1*b*, 1*c* and 1*d* are arranged to surround the bottom panel and the glass panel so that a distance is formed between the bottom panel and the glass panel. This is described in more detail with reference to FIG. 3. The molding 1*b* is split to enable the sideways pulling out of the glass panel 3 to, for example, remove or insert an object into the space formed between the bottom panel and the glass panel. The upper part 4 of the split molding 1*b* is removable so that the glass panel is movable and can be removed from the frame.

Figure 2:
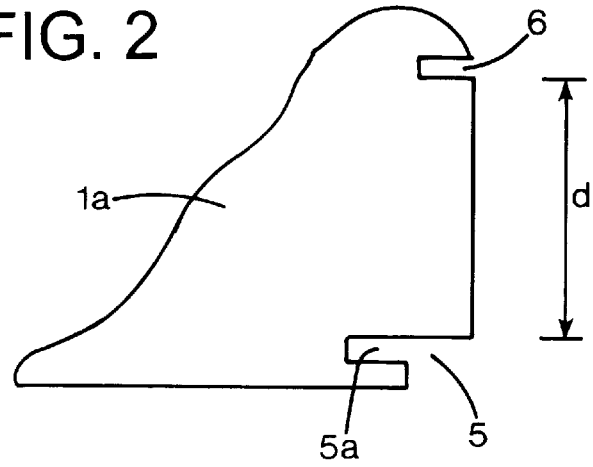
FIG. 2 shows an example of a cross sectional view of a frame molding according to the embodiment shown in FIG. 1.

FIG. 2 shows a cross sectional view of one of the moldings 1*a*, 1*c*, and 1*d*. The molding has a first cavity 5 into which the bottom panel 2 is adapted to be secured. The shape of the cavity 5 allows the bottom panel to be secured thereto in two different ways. In one of the embodiments, the bottom panel 2 and the frame 1 are integrated with one another at the manufacturing because the bottom panel 2 has been inserted into the groove 5*a* of each molding 1*a*, 1*b*, 1*d*. The moldings are then glued together to form the frame 1. In the second embodiment, it is possible after the manufacturing to remove the bottom panel 2. In this embodiment, the bottom panel 2 rests against the wall of the cavity 5 where the cavity does not form the groove 5*a*. Naturally, it is required that the bottom panel is held in place by, for example, adhering the same to the moldings. The moldings 1*a*, 1*c* and 1*d* have further a groove 6 in which the glass panel 3 is adapted to rest when it is placed in the frame 1. With reference to the distance described in FIG. 1, is referred to with d and corresponds to the distance between the cavity 5 and the groove 6. The distance d thus determines the depth of the frame.

Figure 3:
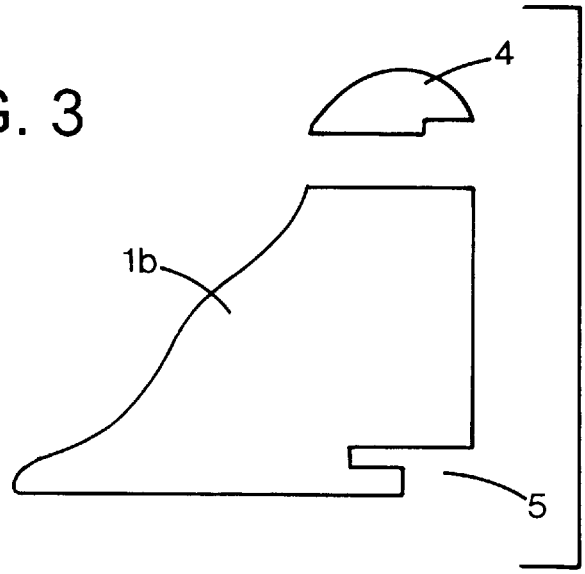
FIG. 3 shows an example of a cross sectional view of a split frame molding according to a second embodiment of the present invention.
Figure 4:
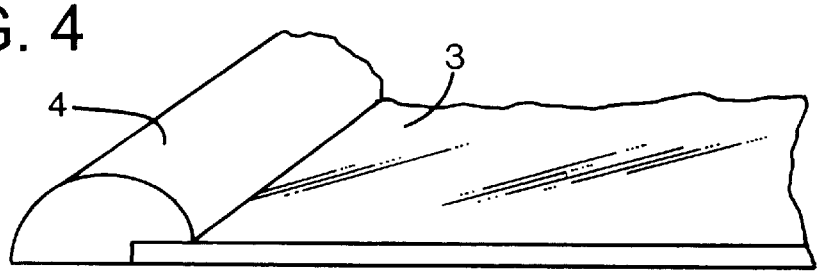
FIG. 4 shows a glass panel on which one part of the split frame in FIG. 3 is attached.

FIG. 3 shows the split molding 1*b* according to one embodiment wherein the upper part 4 of the split molding is attached next to the glass panel 3 so that it is a part of the molding 1*b* when the glass panel is in a closed position. The upper part 4 is attached at the glass panel as shown in FIG. 4, preferably by gluing and functions also as a handle that is pulled sideways to remove the glass panel. The split is arranged at the same height and in line with the groove 6 so, when it is split from the rest of the upper part 4 of the list, forms part of the walls surrounding the groove 6 in such a way that it is possible to remove the glass panel 3 from the frame at the molding 1*b*. If the panel is made from plexiglass, holes can be drilled into the plexiglass and the upper part 4 can be screwed through the holes to the plexiglass.

Figure 5:
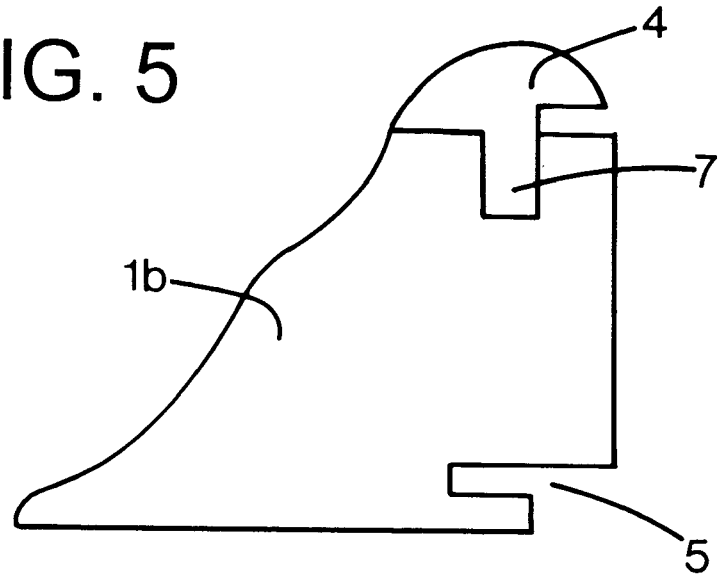
FIG. 5 shows an example of a cross sectional view of a split frame molding according to the first embodiment shown in FIG. 1.

FIG. 5 shows the split molding according to the embodiment in FIG. 1. The upper part 4 has a protruding part 7 and the rest of the molding is a complementary part. In this embodiment, the glass panel 3 is secured in the frame when the upper part 4 is in place so that the upper part 4 is secured to the rest of the molding by pushing in the protruding part 7 into the complementary part. To remove the glass panel the upper part 4 is removed from the rest of the frame. Thereafter, the glass panel 3 is movable sideways and can be taken out of the frame at the molding 1*b*. When returning the glass panel 3, it is inserted into the frame at the molding 1*b* and thereafter the upper part 4 is pushed into place to fixate the glass panel. FIG. 7 shows the list 1*b*, glass panel 3 and the bottom panel 2 in connection with the embodiment illustrated in FIG. 5 in a position when the upper part 4 is in place.

Figure 6:
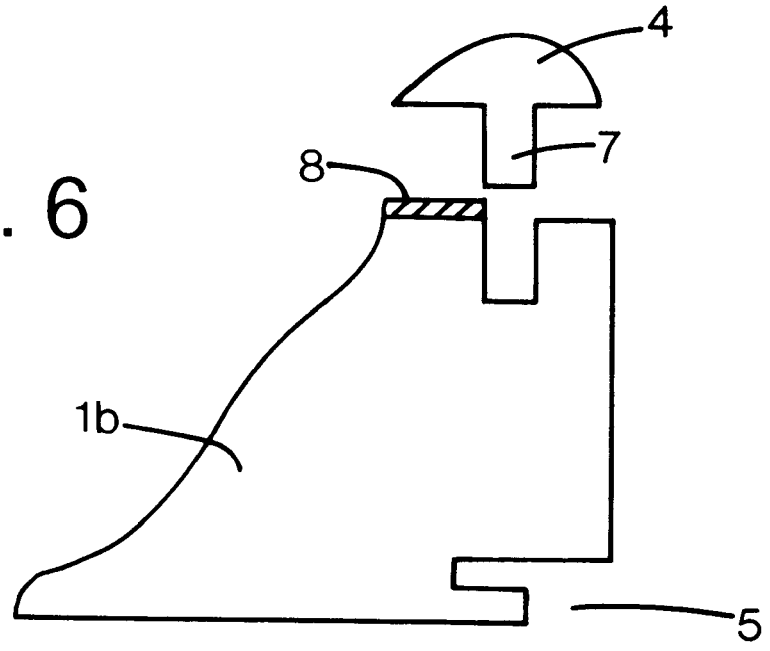
FIG. 6 shows an example of a cross sectional view of a split frame molding according of a third embodiment of the present invention.

In yet another alternative embodiment, the cross sectional view of all the moldings 1*b*, 1*c*, 1*c* is shown in FIG. 6. The embodiment is similar to the embodiment described in connection with FIG. 5 with the difference that the upper part 4 and the complementary design of the rest of the molding are designed so that the rest of the molding has a part 8 that extends across the glass panel wherein when the upper part 4 is removed, the glass panel rests on the edge of the part 8. The glass panel can thus be removed from the frame by lifting it out. This embodiment is especially suitable when the glass panel is cup shaped.

FIG. 8 shown a preferred embodiment in which at least one of the moldings 1*a*, 1*b*, 1*c*, 1*d* has means installed for illuminating the object. The molding that is equipped with illumination has a space formed internally in the molding that has room for the illumination devices (not shown), for example, regular light bulbs. In the illustrated embodiment there is also room for batteries 10*a*, 10*b* that are connected to the lamps to supply them with current. In an alternative embodiment not using batteries, cords can extend from the light bulbs to an adjacent outlet. As shown in FIG. 9, the molding has openings 11*a*, 11*b*, 11*c*, 11*d* disposed between the cavity 5 and the groove 6, that are connected to the above mentioned space 9 to let light through and illuminate the exhibited object.

The moldings 1*a*, 1*b*, 1*c* and 1*d* can be made from any suitable material such as wood and molded plastic. In a preferred embodiment of the bottom panel there is a member (not shown) for hanging the frame.

The frame may be used for exhibiting any type of object such as flower arrangements. Obviously, it is not necessary that the exhibited object has a substantial depth. The object can, for example, be a poster that is glued to the bottom panel.

It should be noted that the above detailed description only describes examples. It is obvious for the person of ordinary skill in the art to imagine a plurality of other embodiments within the scope of the attached patent claims. For example, the frame does obviously not have to be square. It can be triangle shaped as well as oval shaped.

While the present invention has been described in accordance with preferred compositions and embodiments, it is to be understood that certain substitutions and alterations may be made thereto without departing from the spirit and scope of the following claims.

What is claimed is:

1. An arrangement for exhibiting an object, comprising:

a frame molding having a forwardly facing groove;

a bottom panel in operative engagement with the frame molding;

a transparent panel in operative engagement with the frame molding;

a first cavity defined in an inside and around the frame molding, the bottom panel being insertable into the first cavity so that the frame molding surrounds the bottom panel;

a second cavity defined in the frame molding, the second cavity being remotely disposed from the first cavity, the transparent panel being insertable into the second cavity so that the frame molding surrounds the transparent panel and both the bottom panel and the transparent panel extending in a first plane; and a removable member in operative engagement with the frame molding for permitting the transparent panel to be pushed into the frame molding in a setting direction and for permitting the transparent panel to be pulled out of the frame molding in a lifting direction that is opposite to the setting direction, the member having a protrusion that extends perpendicularly to the first plane into the forwardly facing groove of the frame molding, the setting and lifting directions being parallel to the first plane, and the forwardly facing groove facing away from the first plane of the bottom panel and the transparent panel.

2. The arrangement according to claim 1 wherein the removable member is placed on top of the frame molding.

3. The arrangement according to claim 2 wherein the removable member extends along an entire length of the frame molding, the removable member permits the removal of the transparent panel by lifting out the transparent panel in the lifting direction and away from the frame member.

4. The arrangement according to claim 1 wherein the frame molding has means disposed therein for illuminating the object.

* * * * *